US005435225A

United States Patent [19]

Shahinpoor

[11] Patent Number: 5,435,225

[45] Date of Patent: Jul. 25, 1995

[54] OMNI-DIRECTIONAL RAILGUNS

[76] Inventor: Mohsen Shahinpoor, 9521 Avenida Del Oso NE., Albuquerque, N. Mex. 87111

[21] Appl. No.: 186,067

[22] Filed: Jan. 25, 1994

[51] Int. Cl.[6] ..... F41B 6/00

[52] U.S. Cl. ..... 89/8; 124/3

[58] Field of Search ..... 89/8; 124/3; 310/12; 376/101

[56] References Cited

U.S. PATENT DOCUMENTS

| | | | |
|---|---|---|---|
| 4,753,153 | 6/1988 | Jasper | 89/8 |
| 4,760,769 | 8/1988 | Jasper, Jr. | 89/8 |
| 4,858,511 | 8/1989 | Jasper, Jr. | 89/8 |
| 4,934,243 | 6/1990 | Mitcham et al. | 89/8 |
| 5,076,136 | 12/1991 | Aivaliotis et al. | 89/8 |
| 5,078,042 | 1/1992 | Jensen | 89/8 |
| 5,081,901 | 1/1992 | Kemeny et al. | 89/8 |
| 5,127,308 | 7/1992 | Thompson et al. | 89/8 |
| 5,133,241 | 7/1992 | Koyama et al. | 89/8 |
| 5,155,290 | 10/1992 | Hawke | 89/8 |
| 5,183,956 | 2/1993 | Rosenberg | 89/8 |

*Primary Examiner*—Stephen C. Bentley
*Attorney, Agent, or Firm*—Luis M. Ortiz; James H. Chafin; William R. Moser

[57] ABSTRACT

A device for electromagnetically accelerating projectiles. The invention features two parallel conducting circular plates, a plurality of electrode connections to both upper and lower plates, a support base, and a projectile magazine. A projectile is spring-loaded into a firing position concentrically located between the parallel plates. A voltage source is applied to the plates to cause current to flow in directions defined by selectable, discrete electrode connections on both upper and lower plates. Repulsive Lorentz forces are generated to eject the projectile in a 360 degree range of fire.

13 Claims, 4 Drawing Sheets

OMNI-DIRECTIONAL RAILGUNS

The U.S. Government has rights in this invention pursuant to Contract No. DE-ACO4-76DP00789 between the United States Department of Energy and the American Telephone and Telegraph Co.

FIELD OF THE INVENTION

The present invention broadly relates to electromagnetic railgun accelerators and more particularly to an apparatus capable of rapidly launching projectiles to hypervelocity speeds in a 360 degree range of fire.

BACKGROUND OF THE INVENTION

An electromagnetic launcher basically consists of a power supply, and two or more generally parallel electrically conductive rails between which is positioned an electrically conducting armature or projectile. Current from the power supply flows down one rail, through the armature or projectile and back along the other rail whereby a force is exerted on the armature or projectile. This effect is well known to those skilled in the art and is reflected in numerous United States patents. The traditional electromagnetic railgun design, based on conducting parallel rails which form the bore of the accelerator, are described in the following patents: U.S. Pat. Nos. 5,183,956 to G. Rosenburg; 5,155,290 to R. Hawke; 5,133,241 to K. Koyama et al; 5,127,308 to J. Thompson et al; 5,081,901 to G. Kemeny et al; 5,078,042 to D. Jensen; 5,076,136 to E. Aivaliotis et al; 4,934,243 to A. Mitcham et al; and 4,858,511 and 4,760,769 to L. Jasper.

With the exception of patent no. 4,760,769 to Jasper, electromagnetic railgun construction includes one or two sets of parallel, electrically conducting rails. The conducting rails are separated by insulating materials which, combined, are fit together to form a gun barrel assembly used to accelerate projectiles in one direction. The Jasper patent teaches two parallel disks with gaps in their peripheries which are used to convey electrical current. A voltage source is applied to the disks to cause current to flow in opposite directions, generating a repulsive force to eject a projectile. This device depends on a rotator assembly positioned concentrically with the disks to control the timing of the repulsive action and to facilitate reloading. Additionally, projectiles are launched from a fixed cylindrical barrel that is attached to one of the disks.

Devices designed like the Jaspar apparatus are constrained to launch projectiles along the longitudinal axis defined by sets of parallel rails. Additionally, railgun designs typically include insulating material between the conducting rails. These conducting and insulating materials are strapped together in a cylindrical manner to form a railgun barrel, and undergo significant wear every launch from induced magnetic stresses and confined plasma pressures. Unfortunately, insulating materials are somewhat less resilient than electrically conducting materials, and are often the first to mechanically fail in this type of design.

The present invention overcomes these limitations by obviating the need for static rail structures by including electrically conducting parallel plates, and by utilizing insulating material for plate isolation in a non-confining design. The present invention has no railgun barrel, thus minimizing plasma or projectile pressure-related concerns on insulating structures.

The present invention is simpler than the Jasper apparatus in that no concentric rotator assembly is required for repulsive action timing or to facilitate projectile reloading. The present invention is symmetrical with respect to the longitudinal axis defined by the symmetrical support base, and requires no moving parts other than a mechanical means to convey projectiles into the firing position concentrically located between the two plates.

SUMMARY OF THE INVENTION

It is an object of the present invention that the omni-directional electromagnetic projectile propulsion device comprises upper and lower electrically conductive plates arranged in parallel configuration, and perpendicular to the longitudinal axis of the support base; the upper plate is relatively positioned farther away from the invention's support base, and the lower plate is relatively positioned closer to the support base. The lower plate includes a circular hole such that projectiles can move from the projectile magazine into firing position between the parallel plates.

It is another object of the present invention that the parallel plates maintain the parallel configuration with a plurality of insulating tubular support members disposed perpendicularly between the parallel plates.

It is still another object of the present invention that a hollow column provides support for the launching apparatus and attaches to the lower parallel plate at one end, and attaches to a platform on the other end.

It is yet another object of the present invention that the device includes an armature projectile magazine for loading and storing a plurality of projectiles.

It is a further object of the present invention that upper and lower plates include a plurality of electrode connections for the application of high electrical voltage thereto.

The invention is an apparatus for electromagnetically accelerating projectiles to hypervelocity speeds in a 360 degree range of fire. The range of fire is achieved by utilizing circular plates as conductors in place of traditional parallel rails.

The invention includes two electrically conductive, parallel plates positioned with rotational centers aligned longitudinally with the support base longitudinal axis. The plates are preferably circular, however any other geometrically identical plates can be used. The plates are separated longitudinally by insulating support tubes such that projectiles entering from the magazine remain substantially in contact with both upper and lower plate surfaces. The cross-sectional geometry of the plates define a 360 degree range of fire, or "muzzle", for the present invention. Projectiles enter through a hole drilled through the center of the lower plate which connects the projectile magazine to the "breech" of the omni-directional railgun.

The plates are electrically isolated from each other by insulating support tubes. The insulating tubes and plates are assembled into a substantially rigid structure by securing bolts. The insulating tubes also function as conduits for electrical connections to both plates.

A plurality of electrodes are connected to various locations on both the upper and lower plate surfaces. Electrodes are co-located with the securing bolts, but additional electrodes can be positioned equidistantly along the circumference of the lower plate. The electrodes are multiplexed and computer controlled so that one electrode on the upper plate and one electrode on the lower plate are selected for voltage application. The resulting current flows from the selected electrode on the upper plate towards the projectile, through the projectile, and along the lower plate towards the selected lower plate electrode. Current paths through the upper and lower plates produce a pair of Lorentz forces which accelerate the projectile in a predetermined direction. A different acceleration vector is chosen by selecting different upper or lower, or upper and lower plate electrodes.

Additional objects, advantages, and novel features of the invention will become apparent to those skilled in the art upon examination of the following description or may be learned by practicing the invention. The objects and advantages of the invention may also be realized and attained by means of the instrumentalities and combinations particularly pointed out in the appended claims.

BRIEF DESCRIPTION OF THE DRAWINGS

The accompanying drawings, which are incorporated in and form a part of the specification, illustrate an embodiment of the present invention and, together with the description, serve to explain the operation, features and advantages of the present invention, in which.

DETAIL DESCRIPTION OF THE PREFERRED EMBODIMENTS

Figure 1A:
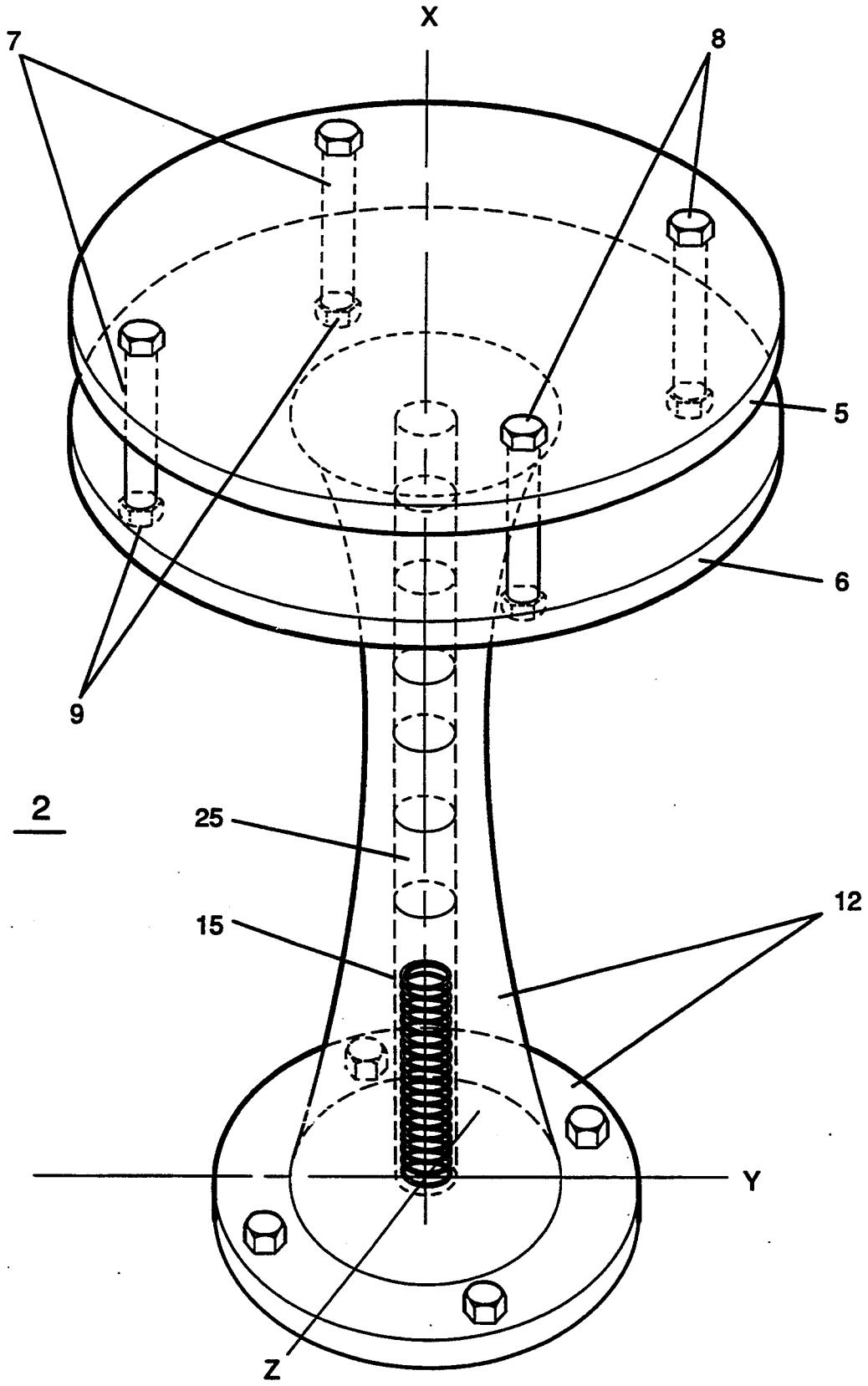
FIG. 1*a* is an illustration of the present invention and defines the longitudinal axis.
Figure 1B:
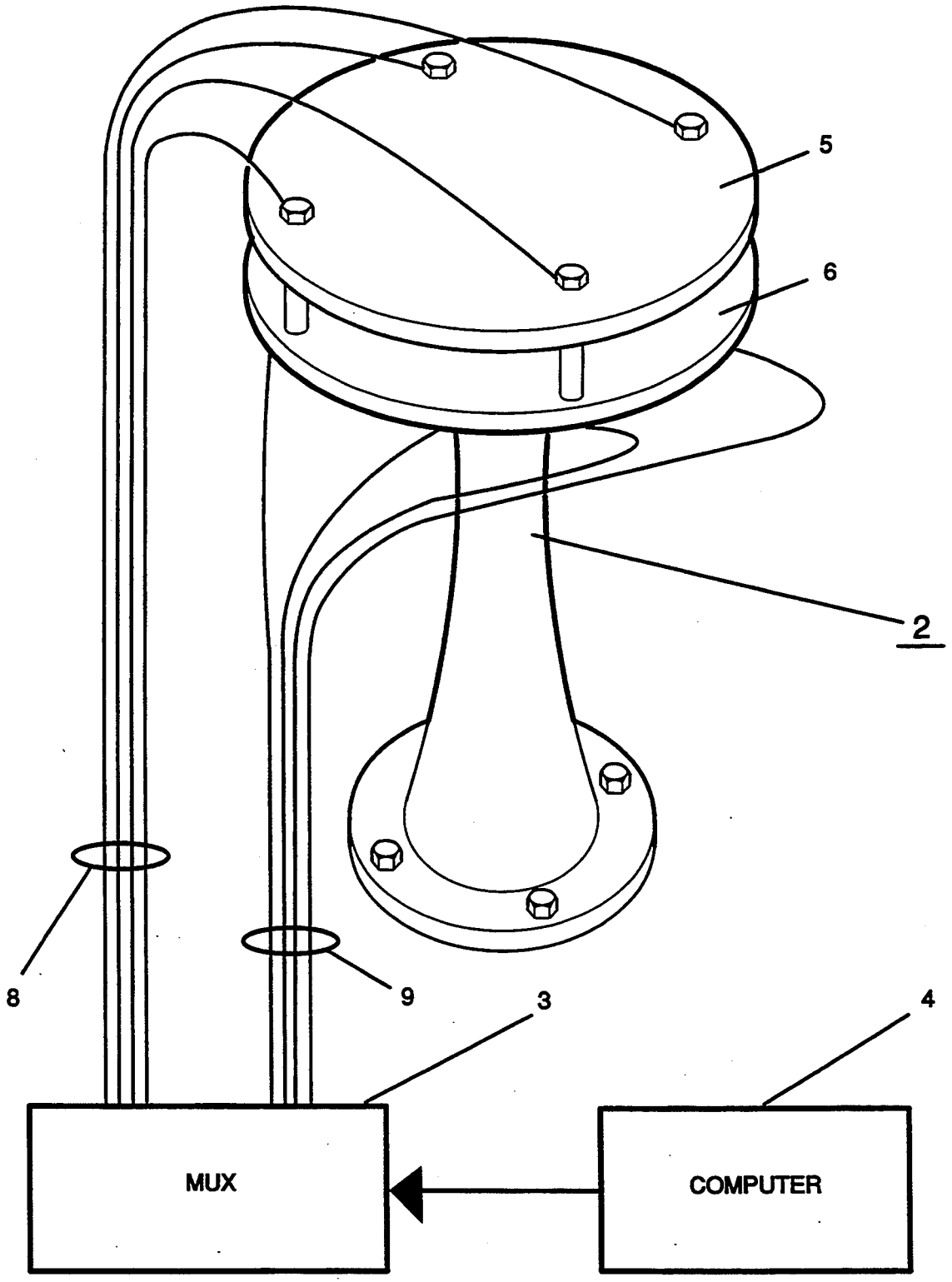
FIG. 1*b* is an illustration of the present invention coupled to a multiplexer and computer.

FIG. 1*a* illustrates the preferred embodiment of the present invention. The following description refers to the preferred embodiment of FIG. 1*a* with clarification provided in FIG. 2. The apparatus 2 includes: upper and lower substantially parallel, geometrically identical, electrically conducting plates 5 and 6; non-conducting insulating support tubes 7; upper plate retention bolts and electrodes 8; lower plate retention bolts and electrodes 9; support base 12; and projectile magazine 15 which contains a plurality of projectiles 25. Referring to FIG. 1*b*, the device 2 is energized by connecting upper plate 5 and lower plate 6 to electrodes represented by leads 8 and 9 respectively, to a power source (not shown). Electrodes 8 and 9 are multiplexed 3 and computer controlled 4 such that voltage can be applied to only one upper plate electrode and one lower plate electrode at any one time. The power source may be any source, such as a battery or battery and capacitor combination or homopolar generator.

Figure 2:
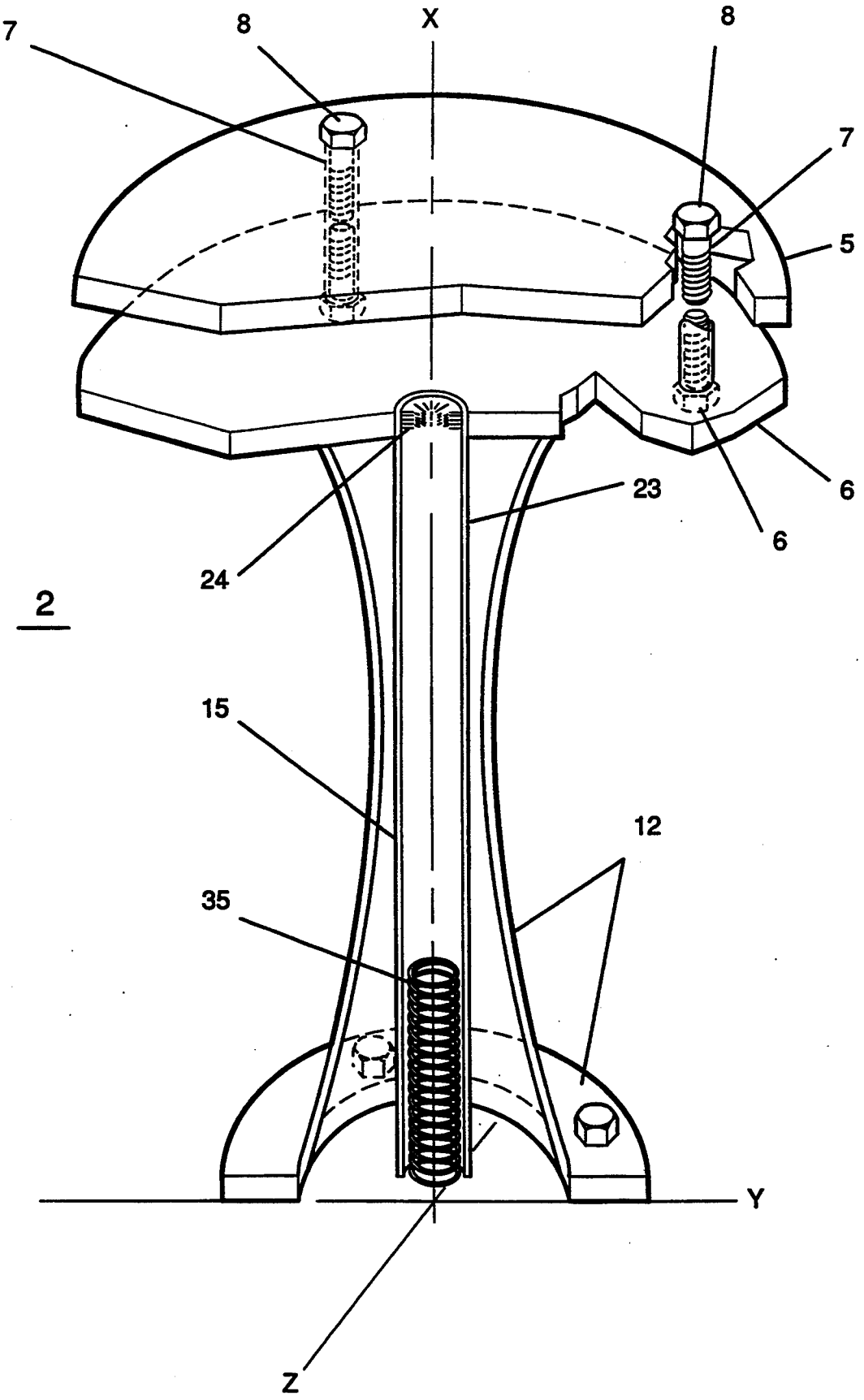
FIG. 2 depicts a cross sectional view of the invention illustrated in FIG. 1.

Referring to FIG. 2, upper plate 5 and lower plate 6 perform the function of "rails" in traditional railgun assemblies, whereby current flows from one of the selected electrodes 8, through upper plate 5 towards the projectile already positioned in firing position (not shown), through the electrically conducting projectile (not shown), and back through lower plate 6 in the direction of the selected electrode 9. Thus, the current flowing in directions defined by electrode selections create magnetic forces on a projectile in the "muzzle" causing acceleration in a desired direction. The present invention can launch either electrically conducting projectiles, or non-conducting projectiles covered with a conducting material. Lower plate 6 includes a concentrically located circular hole 23, which allow projectiles from the projectile magazine 15 to enter the MUZZLE (space between plates 5 and 6). To maintain electrical continuity from upper plate 5, through projectile, and lower plate 6 during apparatus operation, titanium-reinforced graphite fibers or conducting brushes 24 extend into circular hole 23 from plate 6. A preferred embodiment of the present invention is that plates 5 and 6 be made of a copper alloy substantially embodying the characteristics of Glidcop TM, and have radii of approximately three meters.

Insulating support tubes 7 provide electrical separation between plates 5 and 6. Insulating support tubes 7, as the preferred embodiment, are hollow, cylindrically shaped, and threaded inside both ends to receive retention bolts 8 and 9. Support tubes 7 must be strong enough to restrain plates 5 and 6 during projectile acceleration, as well as provide electrical isolation. The support tubes 7 will not be subjected to the confined plasma pressures generated in traditional railguns since there is no feature of the present invention to confine any gas pressures.

There are preferably four insulating support tubes 7 for retaining the plates, 5 and 6. The support tubes 7 are preferably disposed orthogonally to each other at equal radii from the longitudinal axis of the support base 12. The support tubes 7 mate flushly to the upper and lower plates, 5 and 6, and the plates have holes (not shown) that align with the support tubes 7 and match the diameter (not shown) of the internal threading of the support tubes 7 in order to receive the retention bolts, 8 and 9. Therefore, centerlines of the support tubes' 7 and the upper and lower plates', 8 and 9, holes are longitudinally aligned.

Each of the insulating support tubes 7 have upper and lower ends with threads on the inner surface of the upper and lower ends. Threading placed within tubing such as the support tubes 7 is well known in the art. Several acceptable materials can be used to fabricate insulating support tubes and include compositions of polycarbonates, LEXANS TM, G10 TM, or polymides. The upper and lower plates, 8 and 9, can be fabricated with materials such as copper, copper alloys, graphite, and graphite-fiber epoxies. The projectiles launched from the rail-gun apparatus can be fabricated of metal conductive or non-conductive material that is aluminum-coated.

During operation, plates 5 and 6 will separate unless restrained. Securing bolts 8 attach plates 5 and 6 together during the device 2 operation, and are connected to insulating support members 7 by threads. In a preferred embodiment of this invention, the upper plate 5 is attached to four insulating support members 7 by four conducting bolts 8. Further, the four bolts 8 are connected to electrical leads, not shown, supplied through the insulating support tubes 7, and provide four discrete, geometrically defined positions on upper plate 5 for application of electrical current. Lower plate 6 is similarly restrained by retention bolts 9 to the opposite ends of the insulating support tubes 7. Bolts 9 function as the lower plate 6 electrode connections, and additional electrodes can be equidistantly placed around the circumference of lower plate 6.

A support base 12 rigidly attaches plates 5 and 6, securing bolts 8 and 9, and support tubes 7 to a platform, not shown. Support base 12 also insulates lower plate 6 from the attached platform. Support base 12 is generally cylindrical and hollow. The hollow cavity of support base 12 includes a projectile magazine 15. Typical launch platforms could include naval ships, military aircraft, other surface vehicles, and fixed-base sites.

Projectile magazine 15 stores a plurality of projectiles in a cylindrical, spring-loaded queue. Spring 35 ensures that once one projectile vacates the central breech between plates 5 and 6, another projectile is inserted. The projectile magazine 15 and support base 12 are electrically isolated from the launch platform such that electrical current will preferentially flow between electrodes 8 and 9.

Figure 3:
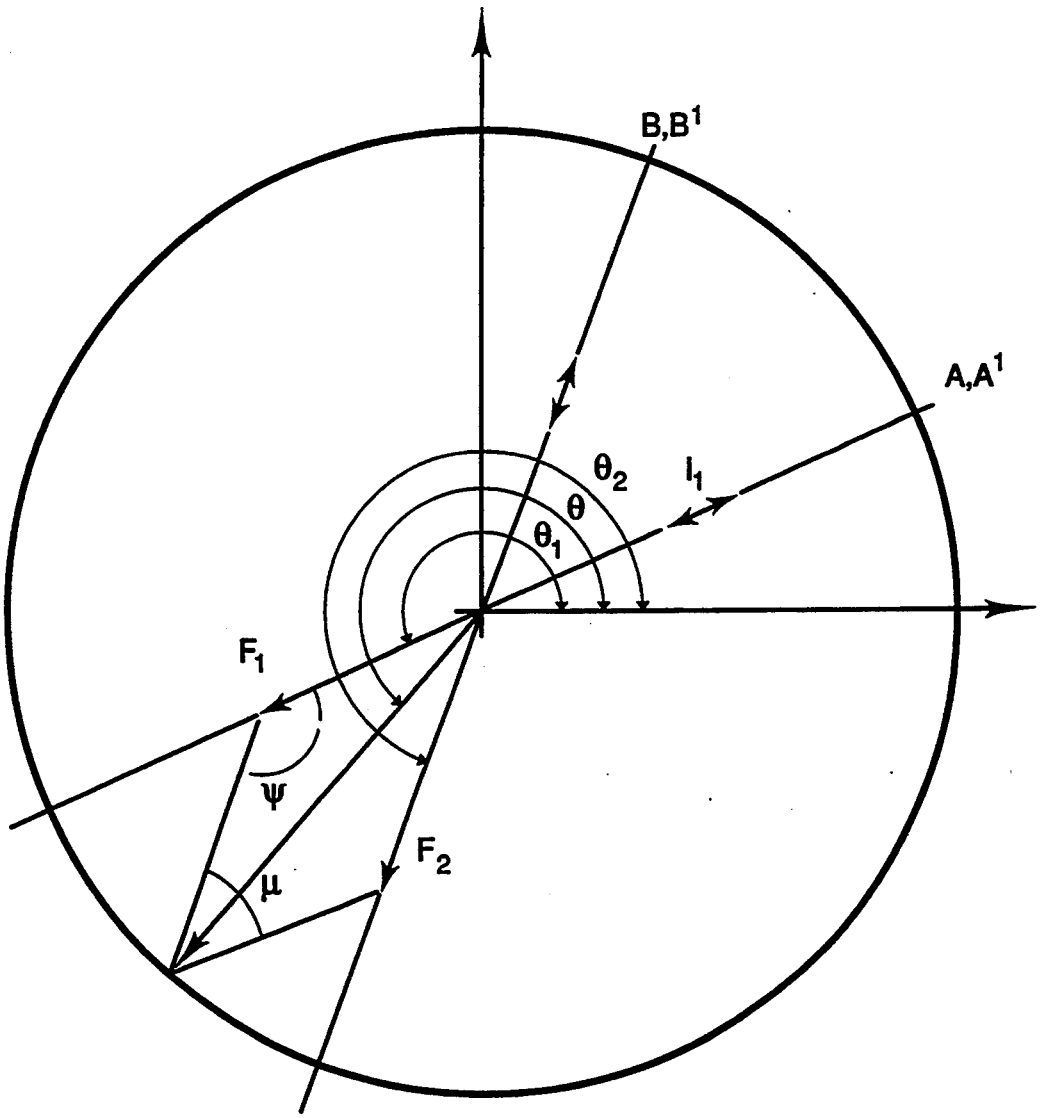
FIG. 3 illustrates the relationship between current flow and Lorentz forces.

FIG. 3 illustrates the relationships between current flow and the resulting Lorentz forces. The relationships shown graphically in FIG. 3, as well as the mathematical treatments that follow permit one skilled in the art to program by computer means the projectile firing solutions. The computer programming effort will also include coded means to ensure that projectiles are not fired through the insulating support members.

To further define the novelty of the present invention and to enable those skilled in the art to computer program firing solutions, the following mathematical treatment is provided. Variables in each of the equations can be modified to fit particular applications without departing from the spirit of the present invention.

One notes that if the magnitude of Lorentz forces in the directions of $\theta_1$ and $\theta_2$ are denoted by $F_1$ and $F_2$, then $$F_1 = \frac{1}{2} L_1 I_1^2 \qquad \text{Equations (1) and (2)}$$

$$F_2 = \frac{1}{2} L_2 I_2^2$$

where L is the inductance of the plates per unit radius, and $\theta_1$ and $\theta_2$ denote the directions of $I_1$ and $I_2$ respectively.

The resulting force F is obtained by the following relationship:

$$F^2 = F_1^2 + F_2^2 - 2F_1F_2 \operatorname{Cos} \Psi \qquad \text{Equation (3)}$$

where $\Psi$ is obtained from the following relationship:

$$\Psi = \pi - \phi \qquad \text{Equation (4)}$$

and $$\phi = \theta_2 - \theta_1 \qquad \text{Equation (5)}$$

or, $$\Psi = \theta_1 - \theta_2 + \pi \qquad \text{Equation (6)}$$

Since $$\operatorname{Cos}(\theta_1 - \theta_2 + \pi) = -\operatorname{Cos}(\theta_1 - \theta_2) \qquad \text{Equation (7)}$$

Thus, $$F = (F_1^2 + F_2^2 + 2F_1F_2 \operatorname{Cos}(\theta_1 - \theta_2))^{\frac{1}{2}} \qquad \text{Equation (8)}$$

The direction of force F is $\theta$ as shown in FIG. 3 is such that $$\theta = \tan^{-1} \frac{(F_1 \sin\theta_1 + F_2 \sin\theta_2)}{(F_1 \operatorname{Cos}\theta_1 + F_2 \cos\theta_2)} \qquad \text{Equation (9)}$$

Having obtained the general direction of motion of the projectile $\theta$ and the total Lorentz force F, the maximum velocity, according to Shahinpoor and Hawke, "Exact Solutions to the Governing Dynamic Equations of Plasma Armature Electromagnetic Railguns," SAND Report 87-0473, UC-32, Sandia National Laboratories, August, 1987, can be written as:

$$v(t) = v_{max} \tanh(\beta t) \qquad \text{Equation (10)}$$

where $$v_{max} = \left[ \frac{LI^2}{2f\left(\frac{m_a}{2D}\right)} + 2b \right]^{\frac{1}{2}} \qquad \text{Equation (11)}$$

and $$\beta = \left[ \frac{\left(Lf\left(\frac{m_a}{2D}\right) + Lb\right)}{2\pi} \right]^{\frac{1}{2}} \left[ \frac{I}{(m_p + m_a)} \right] \qquad \text{Equation (12)}$$

and where f is a drag coefficient, $m_a$ is the mass of any armature formed, $m_p$ is the projectile mass, b is a friction coefficient and I is obtained from the following expressions:

$$(\tfrac{1}{2})LI^2 = [(\tfrac{1}{4})L^2I_1^4 + (\tfrac{1}{4})L^2I_2^4 - (\tfrac{1}{2})L^2I_1^2I_2^2 \operatorname{Cos}(\theta_1 - \theta_2)]^{\frac{1}{2}} \qquad \text{Equation (13)}$$

or, $$I = [I_1^4 + I_2^4 + 2I_1^2I_2^2 \operatorname{Cos}(\theta_1 - \theta_2)]^{\frac{1}{4}} \qquad \text{Equation (14)}$$

For typical values of I=300 Kiloamps, $\mu$=0.35 $\mu$H/m, $m_a \approx 0$, and $b \approx 2 \times 10^{-5}$N s/$m_2$ and t=1 ms, $\beta = 1/150$ sec$^{-1}$, one obtains $$V_{max} \approx 40 km/s \qquad \text{Equation (15)}$$

and $$v(t) = V_{max} \tanh \beta t \approx 6 km/s \qquad \text{Equation (16)}$$

in a length of $$x(t) = 3m \qquad \text{Equation (17)}$$

This length is equal to the radius of plates 5 and 6 in FIG. 1. It should be noted that as the projectile, accelerates between the plates 5 and 6, dynamic changes in Lorentz force vectors will occur and that computer control of electrode selection and power supply is crucial for safety.

The foregoing description of the invention has been presented for purposes of illustration. It is not intended to be exhaustive or to limit the invention to the precise forms disclosed. Obvious modifications or variations are possible in light of the above teachings. The embodiments were chosen and described in order to best illustrate the principles of the invention and its practical application to thereby enable one of ordinary skill in the art to best utilize the invention in various embodiments and with various modifications as are, suited to the particular use contemplated, as long as the principles described herein are followed. Thus, changes can be made in the above-described invention without departing from the intent and scope thereof. It is intended that the specification and the examples be considered as exemplary only, with the true scope and spirit of the invention being indicated in the following claims.

What is claimed is:

1. An omni-directional electromagnetic projectile propulsion device comprising:

a) a hollow support base with a longitudinal axis, b) an electrically conducting upper plate and an electrically conducting lower plate arranged in substantially parallel configuration, said upper plate relatively positioned farther away from said support base, said lower plate relatively positioned closer to said support base, said upper and said lower plates positioned substantially perpendicular to said longitudinal axis of said support base, wherein said longitudinal axis of said support base forms the rotational centerline for said upper and said lower plates, c) a plurality of insulating support tubes disposed substantially perpendicular between said upper plate and said lower plate, and d) a projectile magazine.

2. The electromagnetic propulsion device of claim 1, wherein said upper plate and said lower plate are substantially circular.

3. The electromagnetic propulsion device of claim 1, wherein said lower plate includes a circular hole with a centerline along said longitudinal axis of said support base which forms a cylindrical ring surface within said lower plate.

4. The electromagnetic propulsion device of claim 1, further comprising upper and lower electrodes wherein said upper electrode is coupled to said upper plate and said lower electrode is coupled to said lower plate, and wherein said upper and lower electrodes are coupled to a multiplexer means and said multiplexer means is further coupled to a computer means.

5. The electromagnetic propulsion device of claim 1, wherein:

a) said projectile magazine is concentrically disposed within said hollow support structure and stores a plurality of projectiles, b) said projectile magazine is attached to said lower plate to permit projectile egress from said projectile magazine along said longitudinal axis into the space defined by said upper plate and said lower plate therebetween, and c) said projectile magazine includes a spring loading means to move said projectile through said projectile magazine to a concentrically located firing position between said upper plate and said lower plate.

6. The electromagnetic propulsion device of claim 1, wherein:

a) said propulsion device includes at least four insulating support tubes, b) said insulating support tubes are disposed orthogonally to each other at equal radii from said longitudinal axis of said support base, c) each of said insulating support tubes have upper and lower ends with threads on the inner surface of said upper and lower ends of said insulating support tubes, d) said insulating support tubes mate flushly to said upper plate and said lower plate, and wherein said upper and said lower plate have holes that match said threads on said inner surface of said upper and lower ends of said insulating support tubes, e) centerlines of said support tubes and the holes of said upper and lower plates are longitudinally aligned, and f) said upper and said lower ends of said insulating support tubes provide electrode connection means to said upper plate and to said lower plate for application of electrical voltage thereto.

7. The electromagnetic propulsion device of claim 6, wherein said insulating tubular support members are selected from the group consisting of polycarbonates, LEXANS $_{TM}$, G10$_{TM}$ and polyimides.

8. The electromagnetic propulsion device of claim 1, wherein said insulating support tubes further comprise upper and lower ends, said insulating support tubes are internally threaded to receive threaded bolts, and said upper and lower plates have holes matching the internal threading of said insulating support tubes, wherein a plurality of securing bolts attach said upper plate and said lower plate to said upper and lower ends of said insulating support tubes, said upper and lower ends of said insulating support tubes threadably engaging the threading of said bolts, said bolts passing through the holes of said upper and lower plates before engaging the threading of said insulating support tubes.

9. The electromagnetic propulsion device of claim 8, wherein said securing bolts function as electrodes.

10. The electromagnetic propulsion device of claim 1, further comprising a plurality of conducting brush fibers attached circumferentially on a cylindrical ring surface within said lower plate, wherein said conducting brushes extend substantially perpendicularly to said longitudinal axis of said support base, and said brushes provide electrical continuity through said projectile and said lower plate.

11. The electromagnetic propulsion device of claim 10, wherein said conductive brushes are comprised of titanium reinforced graphite fibers.

12. The electromagnetic propulsion device of claim 1, wherein said upper and lower plates are selected from the group consisting of copper, copper alloys, graphite and graphite-fiber epoxies.

13. The electromagnetic propulsion device of claim 1, wherein said propulsion device can launch conductive projectiles, and metal conductive or non-conductive, aluminum-coated projectiles.

* * * * *